US009238169B1

(12) United States Patent
Chiu

(10) Patent No.: US 9,238,169 B1
(45) Date of Patent: Jan. 19, 2016

(54) MULTI-FUNCTIONAL COMBINATORIAL GAME APPARATUS

(71) Applicant: Yen-Po Chiu, Taipei (TW)

(72) Inventor: Yen-Po Chiu, Taipei (TW)

( * ) Notice: Subject to any disclaimer, the term of this patent is extended or adjusted under 35 U.S.C. 154(b) by 0 days.

(21) Appl. No.: 14/135,706

(22) Filed: Dec. 20, 2013

(51) Int. Cl.

| | |
|---|---|
| ***A63F 9/26*** | (2006.01) |
| ***E01C 13/04*** | (2006.01) |
| ***A63F 9/00*** | (2006.01) |
| ***A63B 67/00*** | (2006.01) |
| ***A63F 3/00*** | (2006.01) |
| *A63B 71/00* | (2006.01) |
| *A63B 9/00* | (2006.01) |

(52) U.S. Cl.
CPC ..... *A63F 3/00895* (2013.01); *A63B 67/00* (2013.01); *A63B 71/00* (2013.01); *A63B 2009/006* (2013.01); *A63B 2208/00* (2013.01); *A63B 2244/00* (2013.01)

(58) Field of Classification Search
CPC ..... A63B 2208/12; A63B 2244/00; A63B 67/00; A63B 71/00; A63B 9/26
USPC ..... 473/415, 422, 278, 438, 446, 452, 465; 273/449, 444, 440, 450; D11/131; 404/19
See application file for complete search history.

(56) References Cited

U.S. PATENT DOCUMENTS

| | | | | |
|---|---|---|---|---|
| 3,229,439 | A * | 1/1966 | Strobel | 404/41 |
| 3,944,654 | A * | 3/1976 | Moore | 273/449 |
| 4,055,341 | A * | 10/1977 | Martinez | 273/110 |
| 7,261,299 | B1 * | 8/2007 | Chiu | 273/440 |
| 7,367,565 | B2 * | 5/2008 | Chiu | 273/449 |
| 7,887,060 | B2 * | 2/2011 | Chiu | 273/449 |
| D668,577 | S * | 10/2012 | Musk | D11/131 |
| 2009/0162143 | A1 * | 6/2009 | Chiu | 404/19 |

* cited by examiner

*Primary Examiner* — Mitra Aryanpour
(74) *Attorney, Agent, or Firm* — Pro-Techtor International Services; Ian Ogleasby

(57) ABSTRACT

A multi-functional combinatorial game apparatus, which includes a base provided with a protruding seat and a recess on the top thereof, and a groove is provided inside the recess. When two adjacent bases are combined together, the inserting groove on the bottom portion of the upper layer base inserts onto the protruding seat or the recess of the lower layer base, thereby enabling a tactile path to be created having undulating ups and downs. In addition, soybeans, sand, small stones, and other tactile objects can be placed inside the grooves on the bases to provide children with different tactile feelings when they are walking and treading on the path.

5 Claims, 4 Drawing Sheets

MULTI-FUNCTIONAL COMBINATORIAL GAME APPARATUS

BACKGROUND OF THE INVENTION (a) Field of the Invention

The present invention relates to a multi-functional combinatorial game apparatus, and more particularly to a multi-functional combinatorial game apparatus having the ability to provide a variety of combinatorial arrangements, and which uses the features of a protruding seat and grooves on the top of a base to construct game apparatuses such as tactile paths, and the like, to improve educational game amusement when teaching or playing games.

(b) Description of the Prior Art

An ordinary conventional game apparatus is a monotonous and crude assembly, the majority of which are produced in geometrical shaped structures such as squares, triangles, or circles. For this reason, the structures only have the capability to be combined in simple arrangements, and the assembled arrangement of shapes from combining the structures are limited. Hence, variability is relatively low, and does not provide for rich creativity. Moreover, such game apparatuses of the prior art do not inspire the intellect of primary school children, and the children often easily become bored playing with such games. Thus, such game apparatuses will be eliminated from the market after a period of time, and, as a result, production manufacturers that develop and design such apparatus are constantly plagued by these problems.

SUMMARY OF THE INVENTION

The primary objective of the present invention is to provide a multi-functional combinatorial game apparatus, comprising a base provided with a protruding seat and grooves on the top thereof. Apart from enabling upper and lower combinatorial arrangements adjoining the base, the multi-functional combinatorial game apparatus allows for left and right transversal combinatorial arrangements adjoining the base, thereby enabling combinatorial arrangements forming a variety of different shapes and multivarious combinatorial game apparatus.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
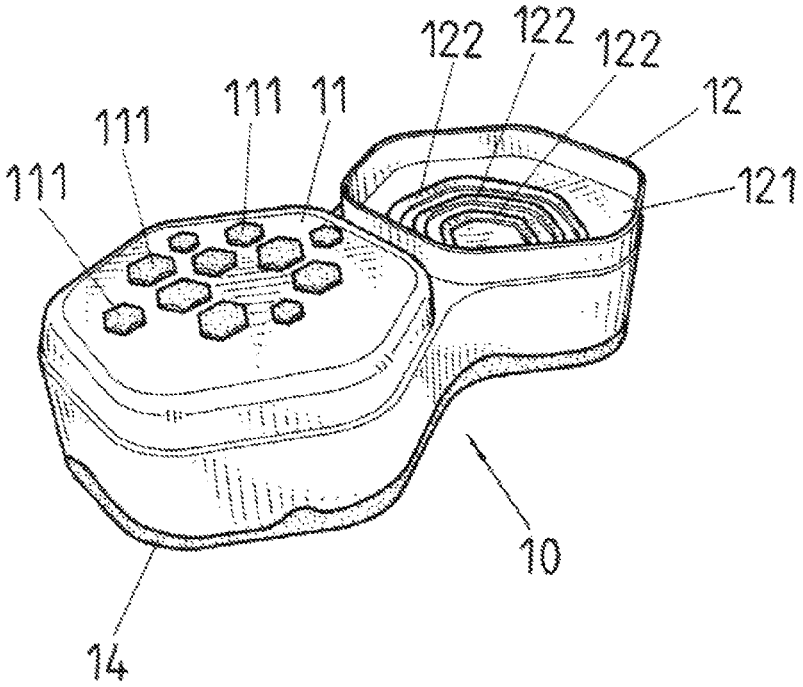
FIG. 1 shows a schematic view of the external appearance of the present invention.

Referring to FIG. 1, the top of a base 10 is provided with a protruding seat 11 and a recess 12. The inside of the recess 12 is provided with a groove 121. The protruding seat 11 and the recess 12 or the groove 121 of the present embodiment are all hexagonal shaped. The protruding seat 11 and the recess 12 can also be formed to be circular shaped or polygonal shaped, and the like, to enable forming different combinatorial arrangements. A plurality of large and small anti-slip pieces 111 of different sizes are located on the top of the protruding seat 11. The anti-slip pieces 111 are formed as hexagonal shapes to match the shape of the protruding seat 11. A plurality of anti-slip strips 122 are located inside the groove 121, and the anti-slip strips 122 are formed as hexagonal shapes to match the shape of the recesses 12.

Figure 2:
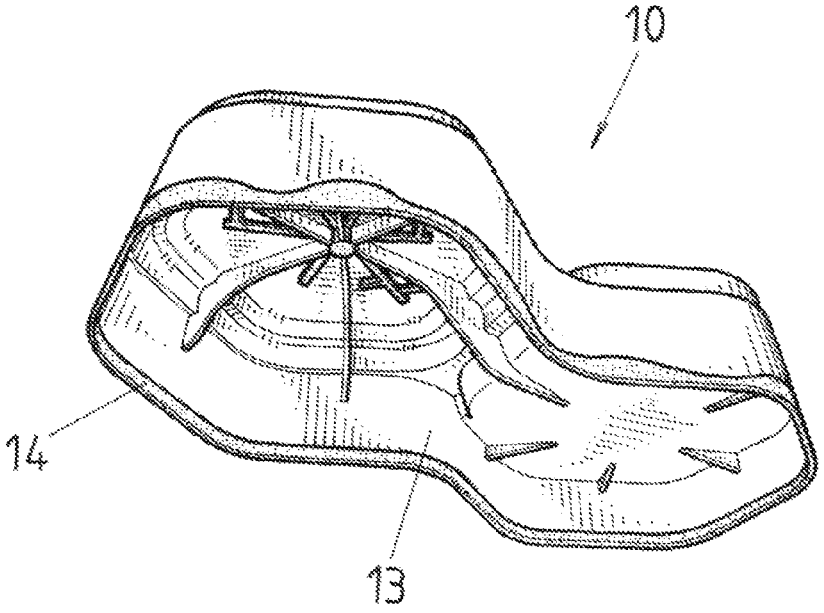
FIG. 2 shows a bottom schematic view of the external appearance of the present invention.

Referring to FIG. 2, the bottom portion of the base 10 is provided with an inserting groove 13, and the inserting groove 13 is formed as a dihexagonal shape. An anti-slip pad 14 is located at the bottom portion of the base 10 and encircles the outer edge of the inserting groove 13.

Figure 3:
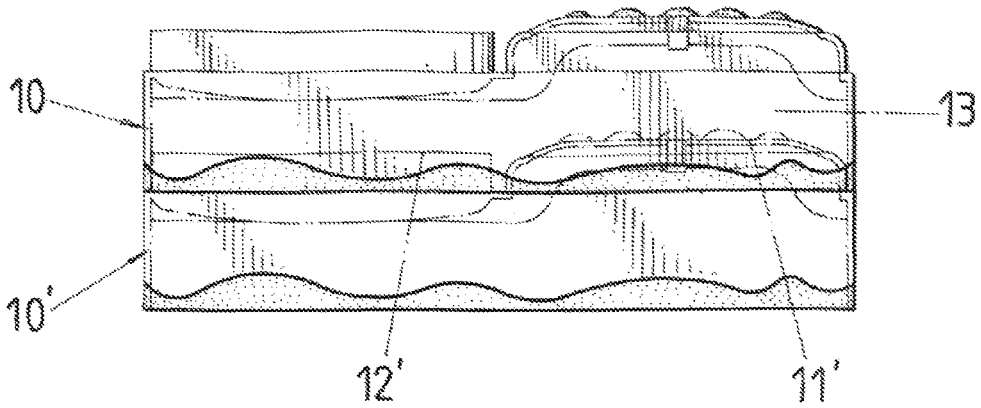
FIG. 3 shows a cutaway view of an assembled arrangement adjoining a base.
Figure 4:
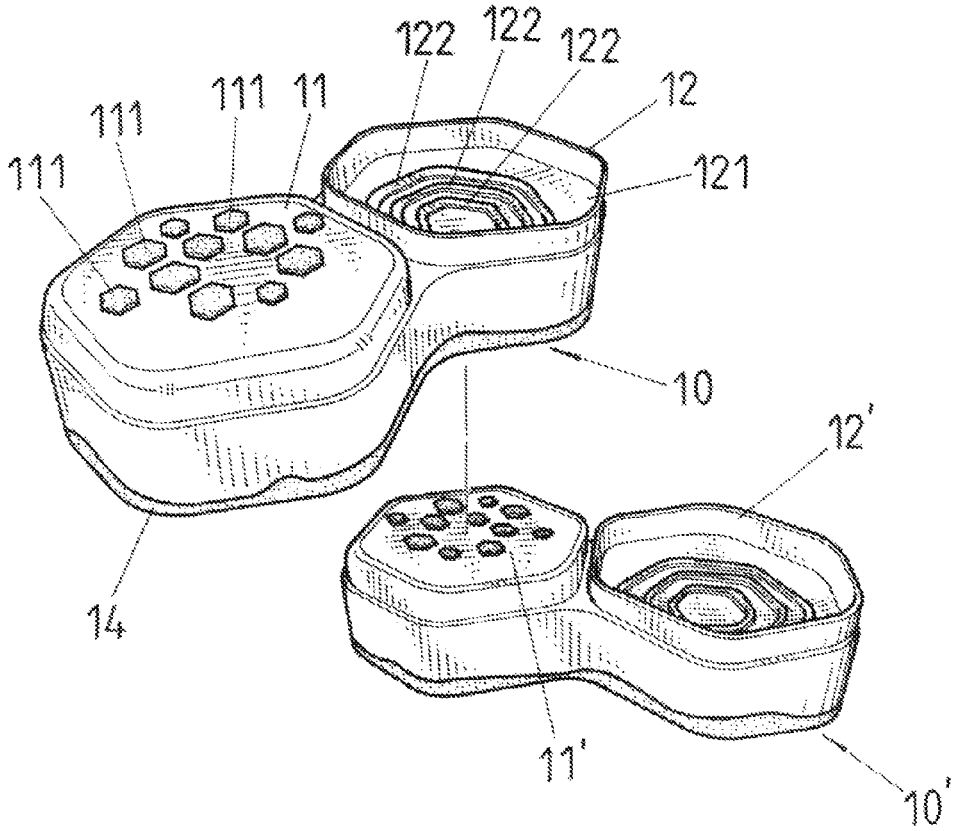
FIG. 4 shows an external view before upper and lower bases are assembled.

Referring to FIG. 3, when two of the bases 10 are stacked on top of each other, the inserting groove 13 of the upper layer base 10 inserts onto a protruding seat 11' and a recess 12' of a lower layer base 10' adjoined to the upper layer base 10, thereby enabling the two bases 10 and 10' to be combined into a single body. FIG. 4 shows a schematic view of the upper and lower bases 10, 10' before being combined.

Figure 5:
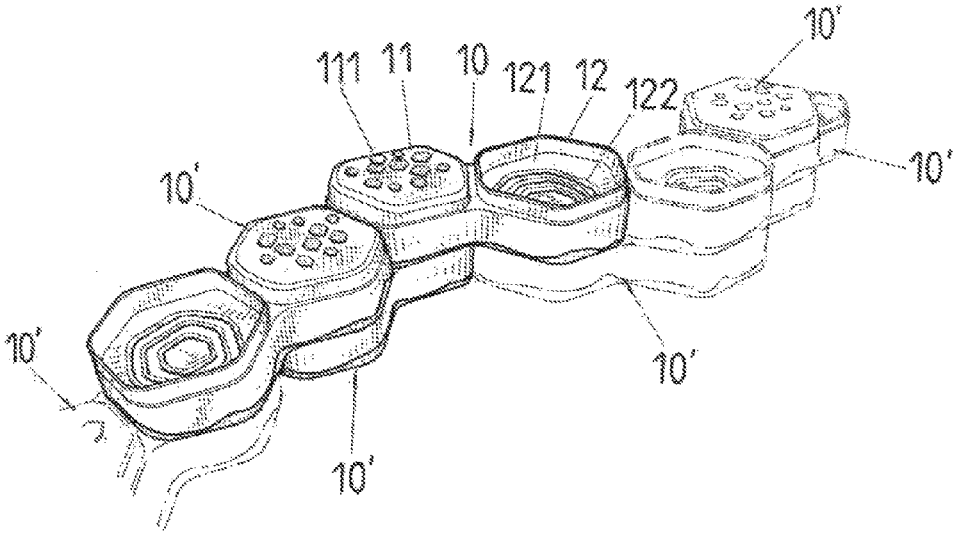
FIG. 5 shows an external view of a plurality of the bases arranged to form a path.

Referring to FIG. 5, which shows a plurality of the bases 10, 10' arranged to form a tactile path providing a surface with undulating ups and downs. When children are walking and treading on the path, the anti-slip pieces 111 on the protruding seats 11 and the anti-slip strips 122 inside the grooves 121 provide an anti-slip effect. Soybeans, sand, small stones, and other tactile objects can be placed inside the grooves 121 to enable improving the adaptive faculty of children walking in different environments.

Figure 6:
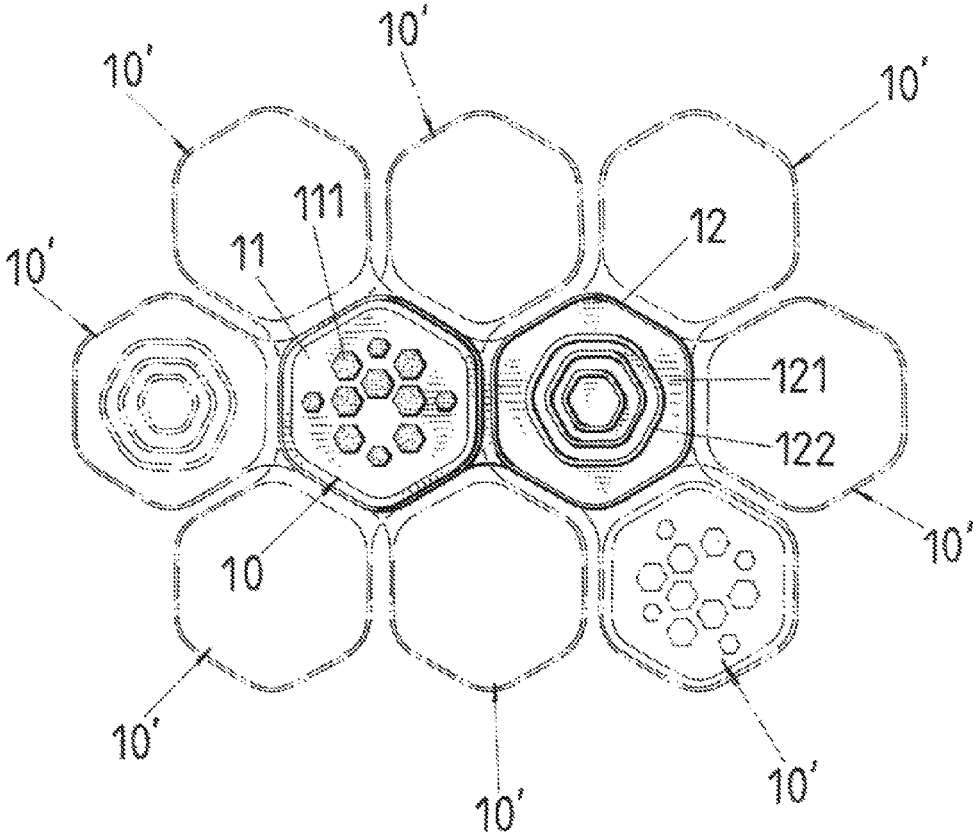
FIG. 6 shows a plan view of a plurality of the bases assembled in a planar arrangement.
Figure 7:
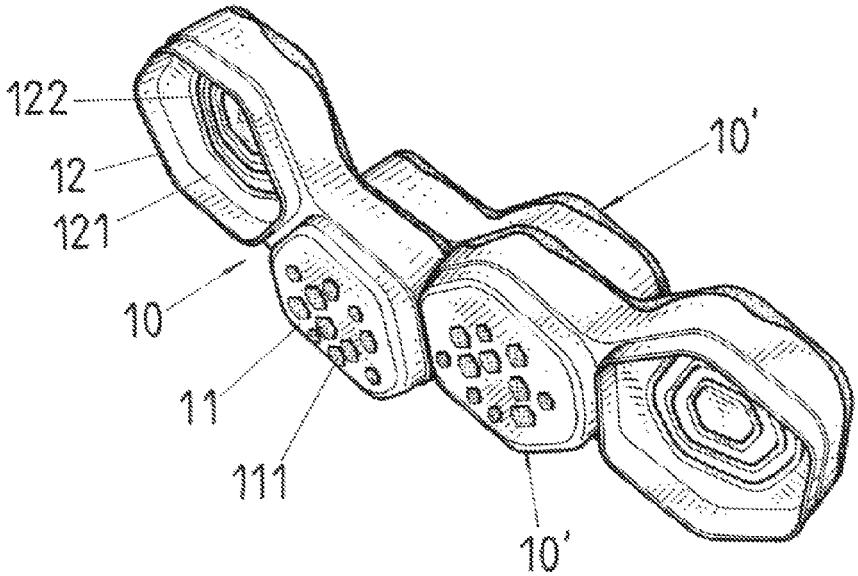
FIG. 7 shows an assembled view of a plurality of the bases assembled in an upright arrangement.

Referring to FIG. 6, when a plurality of the bases 10, 10' are combined, the five corners of each of the bases 10 respectively combine with other groups of the bases 10'. FIG. 7 shows a combinatorial arrangement of a plurality of the bases 10, 10' assembled in an upright arrangement.

In conclusion, a multi-functional combinatorial game apparatus in accordance with the present invention comprises a protruding seat and a recess located on the top of a base, and a groove is provided inside the recess. When a plurality of the bases are combinatorially arranged to extend in all directions, apart from being able to be combinatorially arranged to form tactile paths, moreover, tactile objects can also be placed within the grooves of the bases, or the bases can be stacked to form game apparatuses having a variety of shapes.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A combinable multi-functional game apparatus, comprising:

a plurality of combinable bases;

each base including an upper surface, a lower recessed surface and a thickness therebetween; said upper surface including a protrusion and a depression substantially covering the upper surface of each base;

wherein each depression including a lip extending upwardly from the upper surface of each base and encircling the perimeter of each depression, and including a groove within each depression;

wherein when the plurality of bases are combined, the lower recessed surface of each base respectively inserts into the protrusion and depression of the upper surface of an adjacent base.

2. The combinable multi-functional game apparatus according to claim 1, wherein the protrusion and the depression on the upper surface of each base is hexagonal shaped, and the lower recessed surface of each base is dihexagonal shaped.

3. The combinable multi-functional game apparatus according to claim 1, wherein at least one anti-slip material is positioned on an upper surface of each protrusion.

4. The combinable multi-functional game apparatus according to claim 1, wherein at least one anti-slip strip is positioned within the groove in each depression.

5. The combinable multi-functional game apparatus according to claim 1, wherein an anti-slip pad is positioned on the lower recessed surface, so as to encircle an outer rim of each base.

* * * * *